US008485153B2

(12) United States Patent
Satarino et al.

(10) Patent No.: US 8,485,153 B2
(45) Date of Patent: Jul. 16, 2013

(54) AIR INTAKE APPARATUS

(75) Inventors: Charles Satarino, Milan, MI (US); Jeffrey Lapp, Holland, OH (US)

(73) Assignee: Toledo Molding & Die, Inc., Toledo, OH (US)

( * ) Notice: Subject to any disclaimer, the term of this patent is extended or adjusted under 35 U.S.C. 154(b) by 266 days.

(21) Appl. No.: 12/942,747

(22) Filed: Nov. 9, 2010

(65) Prior Publication Data

US 2011/0107994 A1 May 12, 2011

Related U.S. Application Data

(60) Provisional application No. 61/260,171, filed on Nov. 11, 2009.

(51) Int. Cl.
*F02M 35/10* (2006.01)

(52) U.S. Cl.
USPC ..... 123/184.21; 123/184.61; 181/229; 181/252; 181/258

(58) Field of Classification Search
USPC ..... 123/184.2, 184.61, 184.21; 181/229, 181/252, 258
See application file for complete search history.

(56) References Cited

U.S. PATENT DOCUMENTS

| | | | | |
|---|---|---|---|---|
| 3,360,005 | A * | 12/1967 | Sopher et al. | 137/512.1 |
| 5,722,357 | A * | 3/1998 | Choi | 123/184.21 |
| 6,216,661 | B1 | 4/2001 | Pickens et al. | |
| 6,267,093 | B1 | 7/2001 | Lohr | |
| 6,517,595 | B2 * | 2/2003 | Kino et al. | 55/385.3 |
| 6,553,953 | B1 | 4/2003 | Fujihara et al. | |
| 6,622,680 | B2 | 9/2003 | Kino et al. | |
| 6,877,472 | B2 | 4/2005 | Lepoutre | |
| 6,959,678 | B2 | 11/2005 | Kino et al. | |
| 7,086,365 | B1 | 8/2006 | Teeter | |
| 7,107,959 | B2 * | 9/2006 | Kino et al. | 123/184.57 |
| 7,191,750 | B2 | 3/2007 | Daly et al. | |
| 7,207,307 | B2 | 4/2007 | Ino et al. | |
| 7,322,381 | B2 | 1/2008 | Kino et al. | |
| 7,475,664 | B2 | 1/2009 | Jones et al. | |
| 7,543,683 | B2 | 6/2009 | Lewis et al. | |
| 7,621,372 | B2 * | 11/2009 | Yamaura et al. | 181/229 |

(Continued)

FOREIGN PATENT DOCUMENTS

| | | |
|---|---|---|
| DE | 10304028 | 10/2003 |
| DE | 10200401431 | 10/2005 |
| FR | 2914958 | 10/2008 |
| JP | 2000064918 A * | 3/2000 |

OTHER PUBLICATIONS

Saatitech, "Saatifil Acoustex, Precision Fabrics for Acoustical Applications, Bring Sound to Life", www.saatitech.com, (Apr. 2006).

*Primary Examiner* — Noah Kamen
*Assistant Examiner* — Long T Tran
(74) *Attorney, Agent, or Firm* — McHale & Slavin, P.A.

(57) ABSTRACT

The present invention relates to an air intake duct for an internal combustion engine that is capable of reducing the noise associated with the induction of air. The air intake duct includes an inlet and an outlet as well as an opening in a side wall located between the inlet and outlet. Mounted within this opening is a woven acoustic membrane. The acoustic membrane reduces inlet snorkel noise by dissipating pressure waves in the duct. The woven acoustic membrane is formed from a material that allows sufficient air flow into the air intake duct and also resists water penetration into the air intake duct.

13 Claims, 9 Drawing Sheets

U.S. PATENT DOCUMENTS

2001/0011448 A1* 8/2001 Kino et al. ..... 55/385.3
2002/0020383 A1* 2/2002 Nakano et al. ..... 123/184.61
2002/0129711 A1* 9/2002 Oda et al. ..... 96/134
2004/0226531 A1 11/2004 Kino et al.
2004/0226772 A1 11/2004 Hirose et al.
2004/0231628 A1 11/2004 Jones et al.
2004/0256310 A1* 12/2004 Cheng ..... 210/490
2007/0277768 A1* 12/2007 Takeuchi et al. ..... 123/184.57
2009/0293832 A1* 12/2009 Matsumoto et al. ..... 123/184.61

* cited by examiner

| | PORE SIZE [$um$] | MATERIAL THICKNESS [$um$] | WEIGHT [$g/m^2$] |
|---|---|---|---|
| Example No.1 | 38 | 48 | 25 |
| Example No.2 | 40 | 125 | 85 |
| Example No.3 | 25 | 70 | 55 |
| Example No.4 | 18 | 60 | 50 |

FIG. 6

AIR INTAKE APPARATUS

CROSS REFERENCE TO RELATED APPLICATIONS

The present application claims the benefit of U.S. Provisional Patent Application No. 61/260,171, entitled Air Intake Apparatus, filed on Nov. 11, 2009, the entire contents of which is hereby expressly incorporated by reference.

FIELD OF THE INVENTION

The present invention relates to an air intake duct for an internal combustion engine that is capable of dissipating pressure waves in an intake duct for reducing the noise created by the induction of air.

BACKGROUND OF THE INVENTION

The air induction passageway of an internal combustion engine (ICE) will create a significant amount of noise as the air is drawn into the intake of the induction passageway and conveyed to the inlet of the engine. A typical induction passageway generally includes an air inlet, an air filter or cleaner and passageways or ducts that serve to connect the inlet, and the air cleaner with the intake of the internal combustion engine. The noise generated by an internal combustion engine when installed in a passenger vehicle is a very undesirable attribute. A consumer's comfort and driving experience is often a determinative factor when it comes to the purchase of an automobile or any other type of vehicle. Several attempts have been made to mute or negate these unwanted sounds emanating from the engine compartment of a motor vehicle. Several attempts have included sound attenuating devices incorporated into the air induction system, such as a resonator or muffler. The space within a vehicle's engine compartment is somewhat limited and must be utilized in a judicious manner. Many of these devices by their very nature consume large quantities of precious space that can result in the redesign or removal of other critical components typically located within the engine compartment.

DESCRIPTION OF THE PRIOR ART

U.S. Pat. No. 6,517,595, to Kino et al, discloses an intake duct for introducing outside air into an air cleaner of an internal combustion engine. It includes a hollow duct body with an opening and a piece of non-woven fabric formed in a flat shape, and is joined to the duct body to close the opening. The duct body includes a circumferential wall formed of a resin, and the opening is formed along a plane extending through a portion of the circumferential wall. The piece of non-woven fabric is fixed to the duct body so that some of the resin of the duct body penetrates into the non-woven fabric.

U.S. Pat. No. 6,553,953, to Fujihara discloses at least a part of a duct wall of a suction duct that is formed out of a molded body of non-woven fabric. The non-woven fabric contains a thermoplastic resin binder.

U.S. Pat. No. 6,622,680, to Kino et al, discloses an opening formed in a longitudinal direction in a duct wall. The entire opening is covered with non-woven fabric, and the lateral width of the opening is set to be not shorter than 1/20 of the circumferential length of the duct wall. Alternatively, a porous member is thermally welded with the head of an opening of a small cylindrical portion projecting from the duct wall of a duct body, while the duct body is prevented from deformation. In a method for manufacturing the air intake duct, a high-melting molded piece is brought into contact with a hot plate so as to be heated. A low-melting molded piece is disposed at a distance from the hot plate so as to be heated by radiation heat from the hot plate.

U.S. Pat. No. 6,877,472, to Lepoutre, discloses an intake duct for taking air into an internal combustion engine, notably the engine of an automobile. The duct includes a first wall made of a porous material, wherein a film is implemented which is sufficiently thin thereby avoiding any incidence upon the acoustical characteristics. It has a surface mass of less than 100 grams per square meter. The film is fixed onto the porous wall such that at least 50% of the surface of the film facing the porous wall is not fixed thereto.

U.S. Pat. No. 6,959,678, to Kino et al, discloses a method for making an air intake apparatus. The method includes a holding-portion forming step, a temporary fixing step, and a joining step. In the holding-portion forming step, a holding portion is formed. In the temporarily fixing step, the porous member is held by the holding portion. In the joining step, the holding portion and the porous member are joined together. In the air intake apparatus manufactured by this manufacturing method, a peripheral portion of the porous member is doubly sealed with the holding portion that is an outer edge part of the opening. Consequently, the opening is reliably covered with the porous member so that intake noise is reliably reduced.

U.S. Pat. No. 7,107,959, to Kino et al, discloses an air intake apparatus for suppressing noise. An opening is provided at a part of the intake walls corresponding to an antinode region of resonance mode of standing wave in a full length of the intake path, or at a part of noise pressure level being high in the intake path. The opening is closed with a permeable member and a noise insulating wall is disposed outside the permeable member for suppressing emission of transmitting noise passing through the permeable member. Alternatively, a vibration control member for suppressing face-vibration of the permeable member and reducing radiant noise from the permeable member is provided instead of the noise insulating wall.

U.S. Pat. No. 7,086,365, to Teeter, discloses a composite air intake manifold having a header and runners with communicating passages. The composite intake manifold is fashioned from carbon fiber cloth which is preferably impregnated with resin and cured between a meltable core mold and a split outside mold. The carbon fiber cloth is oriented throughout the manifold to give the manifold maximum pressure resisting capability with minimum thickness and weight. Because virtually any shape may be adopted for the interior passages of the header and the runners, the interior passages of the header and runners may be shaped to enhance air flow through the manifold.

U.S. Pat. No. 7,191,750, to Daly et al, discloses an intake manifold assembly including an inner shell that is inserted into an outer shell, and a cover that seals the open end of the outer shell. The inner shell includes dividers that form air passages. A laser device is traversed along the outer surface of the outer shell along a path which corresponds with the inner shell to form a laser weld joint. The intake manifold assembly of this invention includes features and methods of assembly that improve the laser weld joints utilized to assemble the plastic intake manifold assembly.

U.S. Pat. No. 7,207,307, to Ino et al, discloses an intermediate resin molded body that is put between two outer resin molded bodies, and a molten resin is injected substantially simultaneously into a first interface between one outer resin molded body of the two outer resin molded bodies and the intermediate resin molded body and a second interface between the other outer resin molded body and the intermediate resin body, so that the two outer resin molded bodies and the intermediate resin molded body are welded together.

U.S. Pat. No. 7,322,381, to Kino et al, discloses a duct main body which is formed into a hollow tubular shape having in an interior thereof an intake passageway for introducing outside air into an internal combustion engine by connecting integrally a plurality of divided bodies such as a first divided body and a second divided body which are formed of a thermoplastic resin and has, in a duct wall of the second divided body, an opening which establishes a communication between the inside and outside of the intake passageway. An air-permeable member is insert molded in the second divided body in such a manner as to cover the opening. The air-permeable member has, on an outer edge thereof, a joining portion which is impregnated with the thermoplastic resin. The second divided body has, in at least part of an inner peripheral edge of the opening, a vertical wall portion which protrudes outwards from the duct wall of the second divided body along an inner edge of the opening, and at least part of the joining portion of the air-permeable member is embedded in the vertical wall portion in such a manner as to be held therein in a thickness direction.

U.S. Pat. No. 7,475,664, to Jones et al, discloses an engine intake manifold assembly, including a first component having a first mating surface and a second molded plastic component having a second mating surface. The second molded plastic component is adhesively bonded to the first component with an adhesive. The adhesive bond strength exceeds the strength of the second molded plastic component.

U.S. Pat. No. 7,543,683, to Lewis et al, discloses a vehicle resonator structure including a resonator chamber that has a first intake tube and a first exhaust or outlet tube attached thereto. At least one of the tubes includes a projection that can be molded (e.g., via flash molding after the tube itself is blow molded) onto the tube. The resonator chamber can include upper and lower tube mount structures that can be hot plate welded and sandwiched onto the projection in the tube. Thus, the tube(s) is/are positively retained in position with respect to the resonator chamber such that the tuning of the resonator does not change due to fluctuations in geometry of the tube(s) and resonator chamber structure, and such that there is little or no vibration noise and/or possible damage that might result if the tube(s) were free to move with respect to the resonator chamber.

U.S. Publication No. 2004/0226531, to Kino et al, discloses an air intake apparatus including an air intake duct provided with an inlet through which intake air is introduced, an air cleaner disposed on the downstream side of the air intake duct for filtering the intake air, and an air cleaner hose disposed on the downstream side of the air cleaner and for supplying the filtered intake air to a combustion chamber of an engine, wherein an intake air passageway is laid out between the inlet and the combustion chamber. A passageway wall surrounding an antinode of a lower resonance mode corresponding to the whole passageway length of the intake air passageway, a valve for opening a communicating path allowing the inside of the intake air passageway to communicate with the outside thereof, at least when the lower resonance mode occurs, and an air-permeable member disposed to block the communicating path are disposed.

U.S. Publication No. 2004/0226772, to Hirose et al, discloses a permeable port constituted by an aperture and a porous member for covering an aperture that is provided in a part of an intake air passageway portion of an air intake apparatus. The permeable port is disposed in at least a part of a region between the central position of the whole length of an air intake duct and the central position of the whole length of the intake air passageway portion.

U.S. Publication No. 2004/0231628, to Jones et al, discloses an engine intake manifold assembly, including a first component having a first mating surface and a second molded plastic component having a second mating surface. The second molded plastic component is adhesively bonded to the first component with an adhesive. The adhesive bond strength exceeds the strength of the second molded plastic component.

SUMMARY OF THE INVENTION

The present invention is directed to an air intake duct for an internal combustion engine that is capable of suppressing the noise created by the induction of air. The air induction passageway includes an intake duct having an inlet and an outlet as well as an opening in a side wall located between the inlet and outlet. Mounted within this opening is a membrane formed from a woven acoustic material. The acoustic membrane reduces inlet snorkel noise by dissipating pressure waves in the duct. The acoustic membrane is formed from a woven material that allows sufficient air flow into the air intake duct and also resists water penetration into the air intake duct. The air intake silencing device is compact in design, easy to install and maintain, efficient in performance, and economical to manufacture.

Accordingly, it is an objective of the instant invention to provide an intake silencer that utilizes a woven fabric material that is effective in reducing the noise generated by the induction passageway of an internal combustion engine.

It is a further objective of the instant invention to provide an intake silencer that utilizes a woven fabric that is effective in reducing intake noise and is also resistant to water penetration.

It is yet another objective of the instant invention to provide an intake silencer for an internal combustion engine that is small in size thereby minimizing engine compartment utilization.

It is a still further objective of the invention to provide an engine intake silencer that is effective, durable, and cost effective to manufacture, install, and maintain.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIG. 6 is a chart describing the physical properties of four examples of material for the woven acoustic membrane.

DETAILED DESCRIPTION OF THE INVENTION

The present invention will now be described more fully hereinafter with references to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
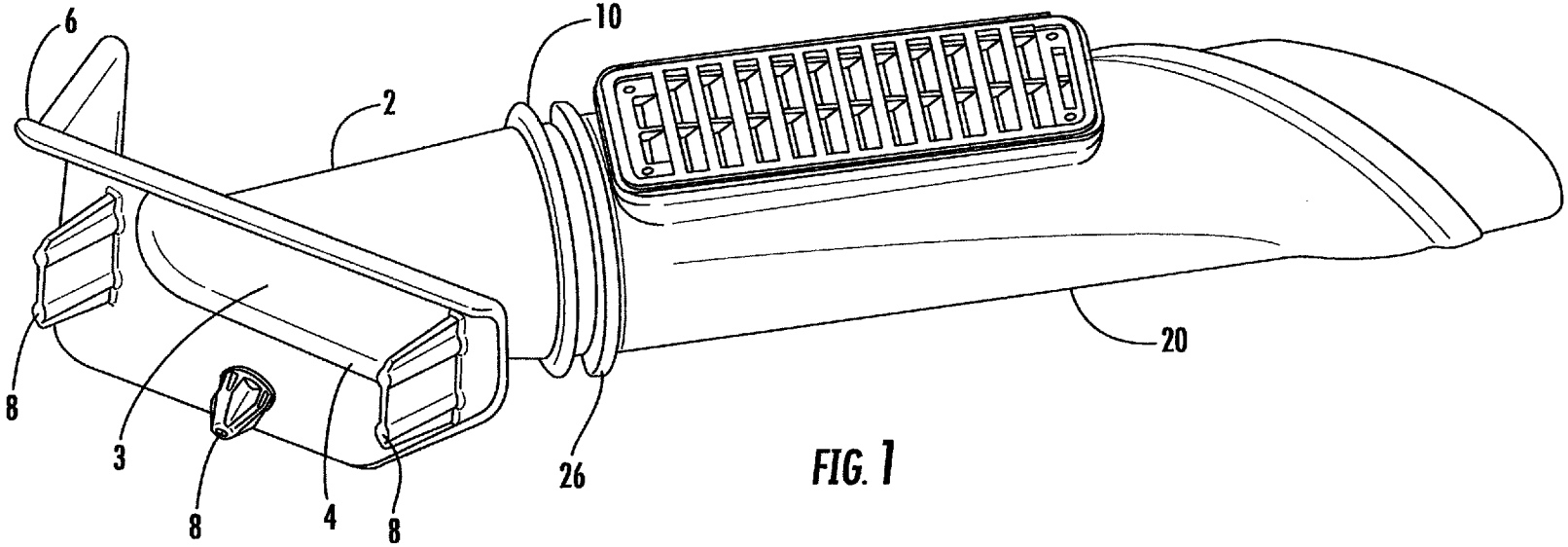
FIG. 1 is a perspective view of a portion of the induction passageway including the acoustic membrane.

FIG. 1 is a perspective view of a portion of the induction passageway including an acoustic membrane. The air inlet silencer assembly includes an inlet component 2 having a longitudinally extending passageway 3 extending between an inlet side 4 and an outlet side 10. Inlet component 2 is formed by any conventional plastic forming technique. The inlet side 4 of inlet component 2 is configured to operatively engage the vehicle sheet metal. The passageway at the inlet side 4 of inlet component 2 is generally oval; however the oval shape is not necessary; a passageway that is round or rectangular in cross section will suffice without detracting from the invention. The inlet side 4 of inlet component 2 includes an L shaped wall 6 that includes indexing, reinforcement and attachment elements 8. Elements 8 cooperate with elements located on the vehicle structure. The longer leg of the L shaped wall 6 is formed at an oblique angle with respect to the axis of longitudinally extending passageway 3. The outlet side 10 of inlet component 2 is also generally oval shaped in this embodiment; however the shape is application specific in a manner as discussed with respect to the inlet. The outlet side 10 is sized and configured connected with an intake duct portion 20.

Figure 2:
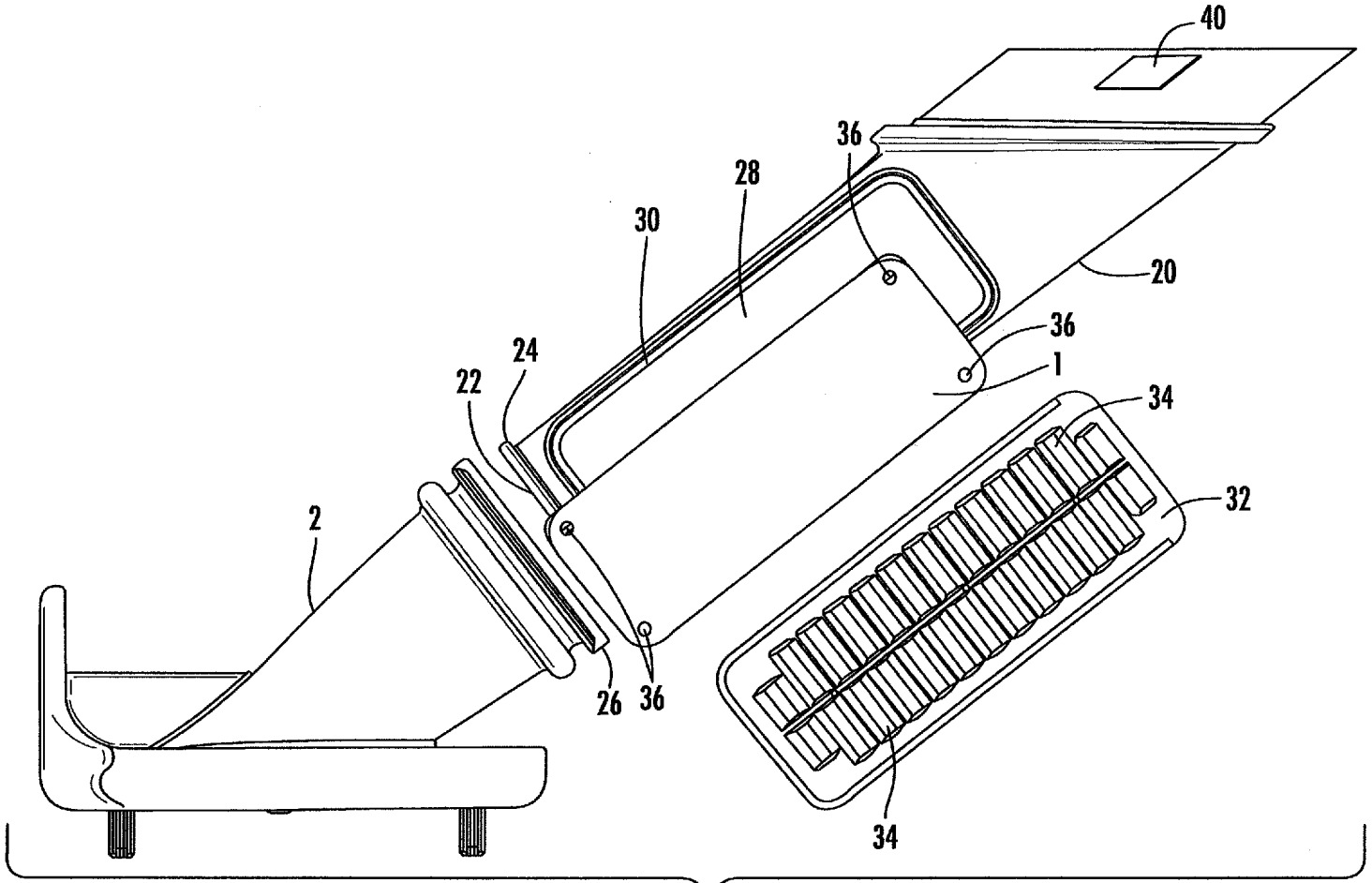
FIG. 2 is an exploded bottom perspective view of the induction passageway including the acoustic membrane.
Figure 3:
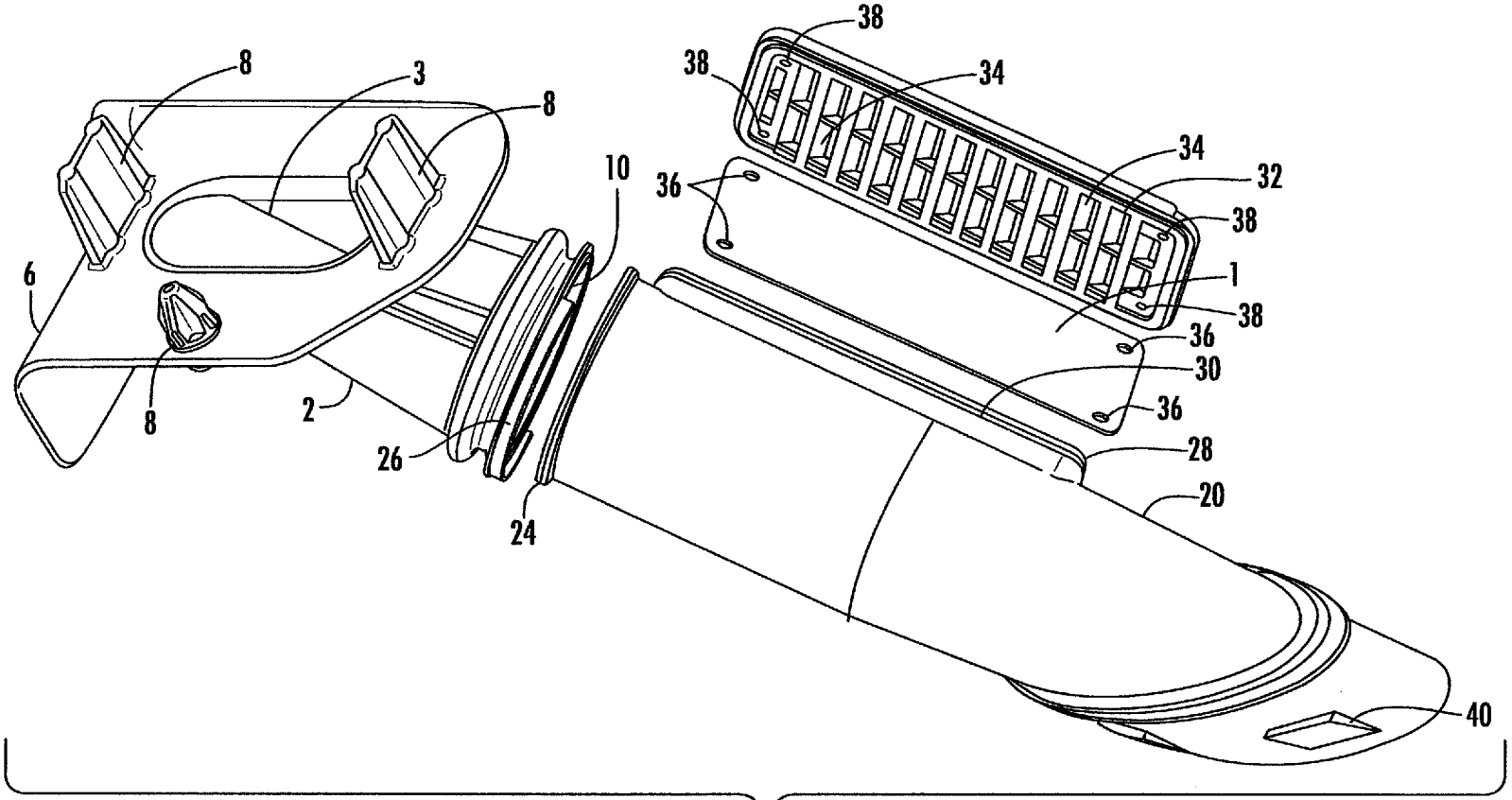
FIG. 3 is an exploded top perspective view of the induction passageway including the acoustic membrane.

FIG. 2 is a bottom perspective view of the air induction passageway with parts shown in an exploded fashion for purposes of clarity. Preferably the acoustic membrane 1 is located on the underside of the intake duct 20 when installed within the vehicle engine compartment. FIG. 3 is a top perspective view of the air induction passageway with parts shown in an exploded fashion for purposes of clarity. As shown in FIGS. 2 and 3, the air inlet silencer assembly also includes an intake duct 20. The intake duct 20 includes an inlet 22 that is generally oval in cross section for this embodiment; the actual shape is application specific. The inlet 22 also includes a flange 24 that projects radially outward from the surface walls of the intake duct 20. Flange 24 operatively engages groove 26 located on the outlet side 10 of inlet component 2. When the flange 24 is seated within groove 26, the intake duct 20 and inlet component 2 are mechanically and fluidly connected to one another. The front bell mouth, as shown, includes a soft portion for the forward end of the inlet that is welded to inlet component, or could also be molded as a single piece, and is application specific. The intake duct 20 includes an opening 28 that is generally rectangular in shape formed on its outer surface. Surrounding rectangular opening 28 is a continuous upstanding flange 30 which is formed on the outer surface of intake duct 20. The flange 30 is directed radially outward from the surface of intake duct 20. An acoustic membrane 1 is sized to fit within the flange 30 and overlay the rectangular opening 28. A rectangular grid 32, having an outer perimeter frame that conforms to the inner rectangular perimeter formed by flange 30, maintains the woven acoustic membrane 1 in place on the intake duct 20. The grid 32 also includes a plurality of similarly angled louvers 34. The acoustic membrane 1 and grid 32 are secured in position on the intake duct 20 with mechanical fasteners, thermally welding, or otherwise molded in place. The rectangular acoustic membrane 1 includes apertures 36 formed adjacent each of the four corners as shown in FIGS. 2 and 3. Likewise the rectangular grid has a circular recesses 38 formed in each of the four corners of the grid 32. Apertures 36 and recesses 38 located in each of the corners are in alignment when the acoustic membrane 1 and grid 32 are positioned within flange 30 on intake duct 20. Acoustic membrane 1 can be attached to grid 32 by suitable fastening means such as plastic insert molding, adhesive, or mechanical fasteners.

Figure 4:
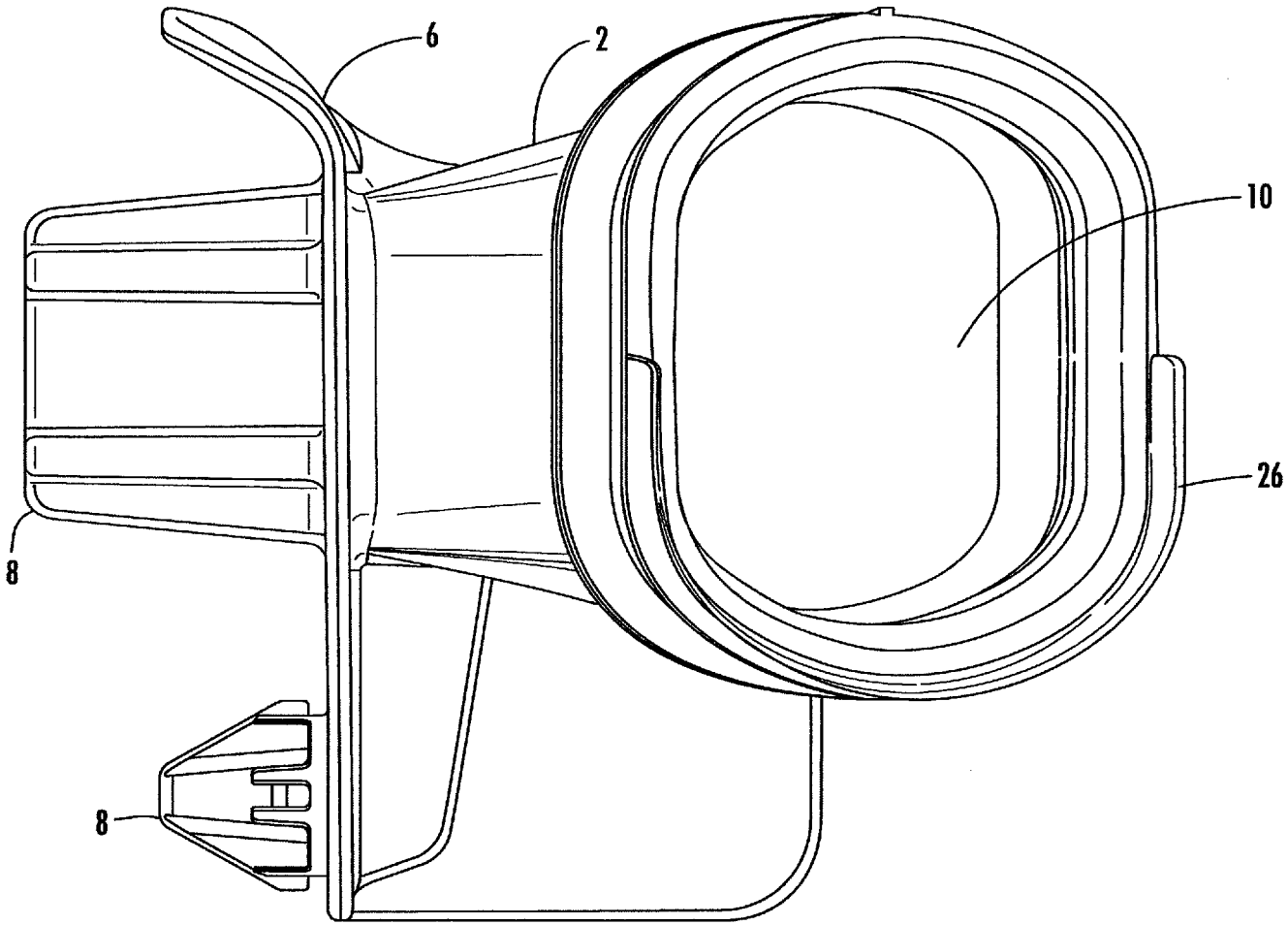
FIG. 4 is a perspective view of the outlet side of the inlet component of the induction passageway.

FIG. 4 is a perspective view of the outlet side of the inlet component 2 of the induction passageway. As shown in FIG. 4, air inlet component 2 includes an oval shaped outlet side 10 and groove 26. Fastening and positioning elements 8 and an L shaped wall 6 are sized and configured to secure the inlet component 2 to the vehicle structure.

Figure 5:
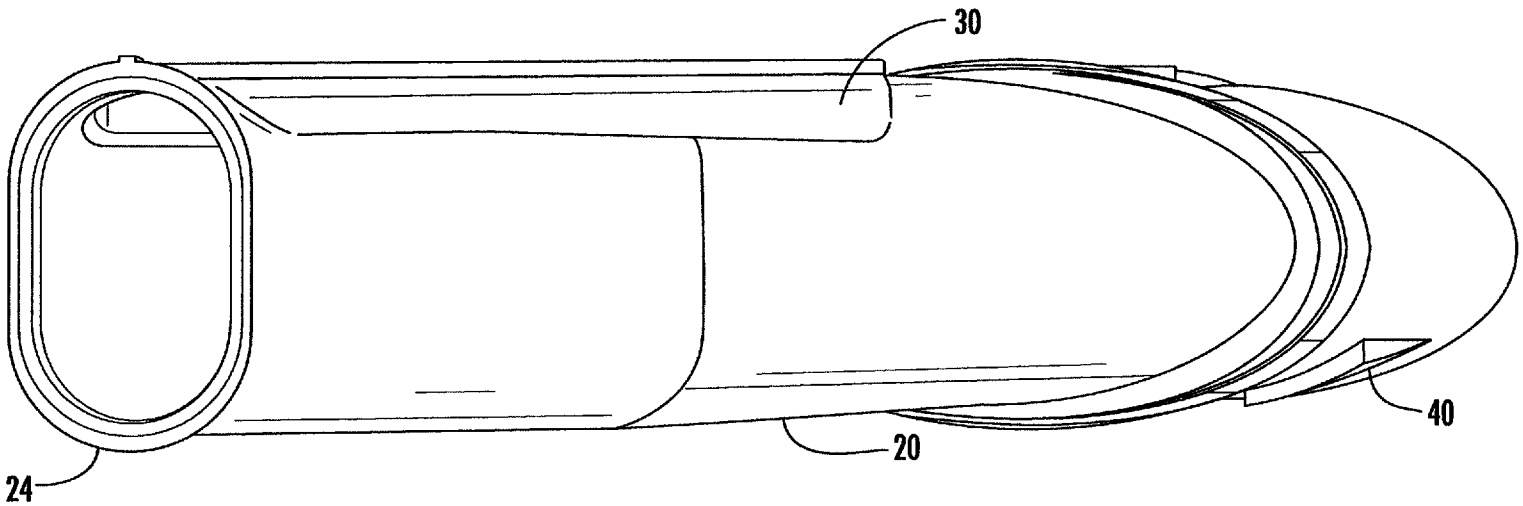
FIG. 5 is a side perspective view of the intake duct.

FIG. 5 is a side perspective view of the intake duct 20. As shown in FIG. 5, intake duct 20 has an oval shaped passageway extending between the inlet and outlet side of intake duct 20. The inlet side includes a mounting flange 24 configured to mate with groove 26 on inlet component 2. The upper portion of intake duct 20 includes rectangularly shaped flange 30. The intake duct 20 is formed by any conventional plastic forming technique. The outlet side of intake duct 20 is fixed and configured for suitable connection to other parts of the intake manifold system, such as an air cleaner housing, a further intake duct, an intake manifold or a throttle body housing with fastening and indexing elements 40 molded into the outer surface.

Acoustic membrane 1 is formed from a woven material such as that made by SaatiTech® under the trademark Saatifil Acoustex™. This material is precisely woven with mono filament fibers to produce uniform mesh openings, thereby creating consistent acoustical resistance. The fibers can be made from polyester, metalester or any other suitable synthetic material. The woven material forming the acoustic membrane 1 within the air intake duct has a pore size than falls within the range of 38 um to 18 um and the thickness falls within the range of 40 um to 125 um. The material of the acoustic membrane 1 is finished with a coating that enables the membrane to repel water.

The acoustic membrane has the physical properties needed to reduce the noise generated within the intake passageway by dissipating pressure waves in the duct. It will also provide the required airflow resistance to allow for the proper balance of air entering the intake passageway through the membrane, and it must also be resistant to the intrusion of water into the intake system. The following tests have been conducted concerning the aforementioned criteria.

FIG. 6 is a chart defining the physical properties of four examples having a different pore size, material thickness and weight used to conduct the previously mentioned tests.

Figure 7:
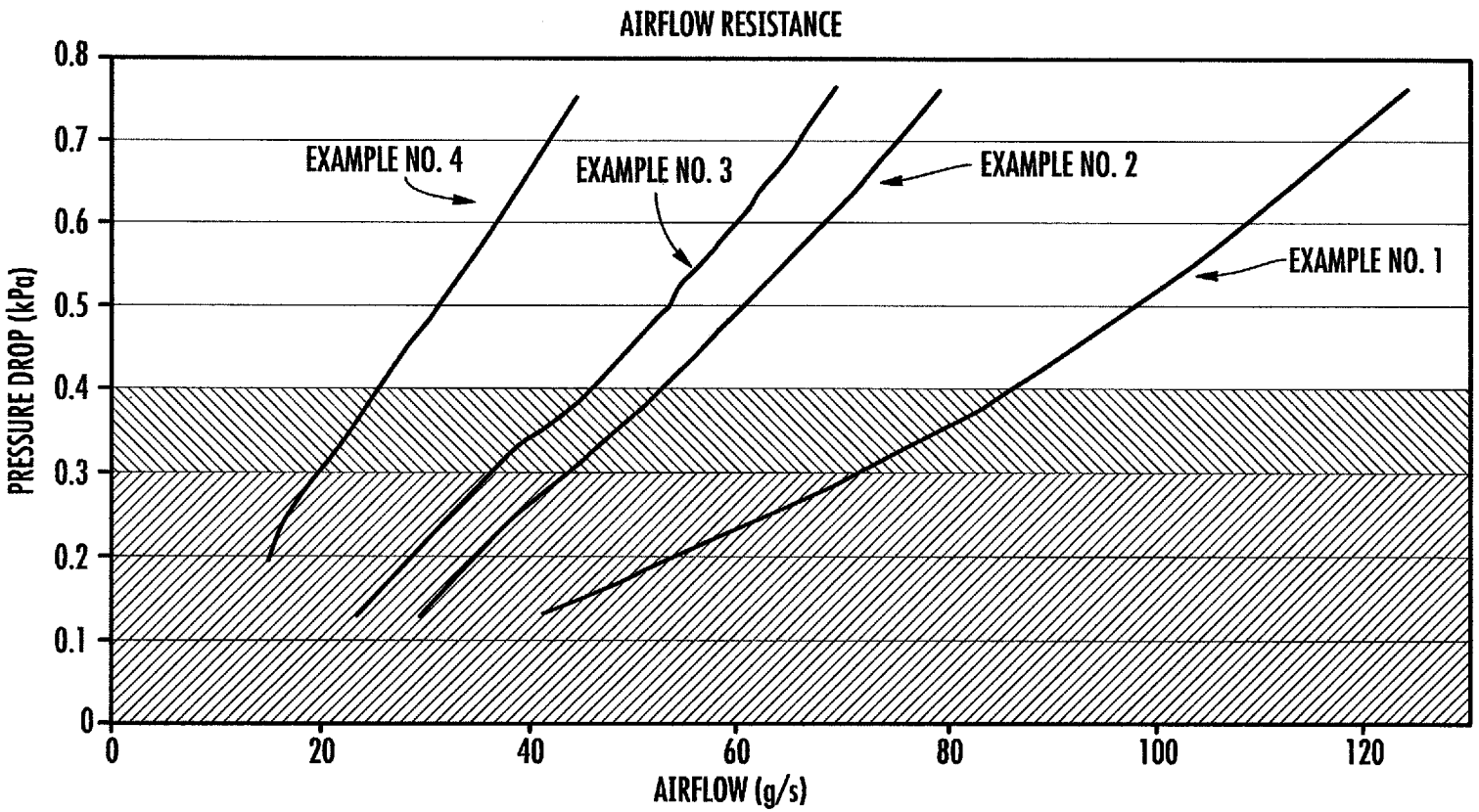
FIG. 7 is a graphical representation of the airflow resistance test data illustrating the pressure drop as a function of airflow for each of the four examples of woven acoustic material.

To measure airflow resistance, a test sample of the material was mounted on an airflow tunnel and various levels of airflow from a calibrated source were introduced. The pressure drop across the sample was measured at various flow rates. The graph in FIG. 7 represents the results for each of the four examples whose physical properties as shown in the chart of FIG. 6.

Figure 8:
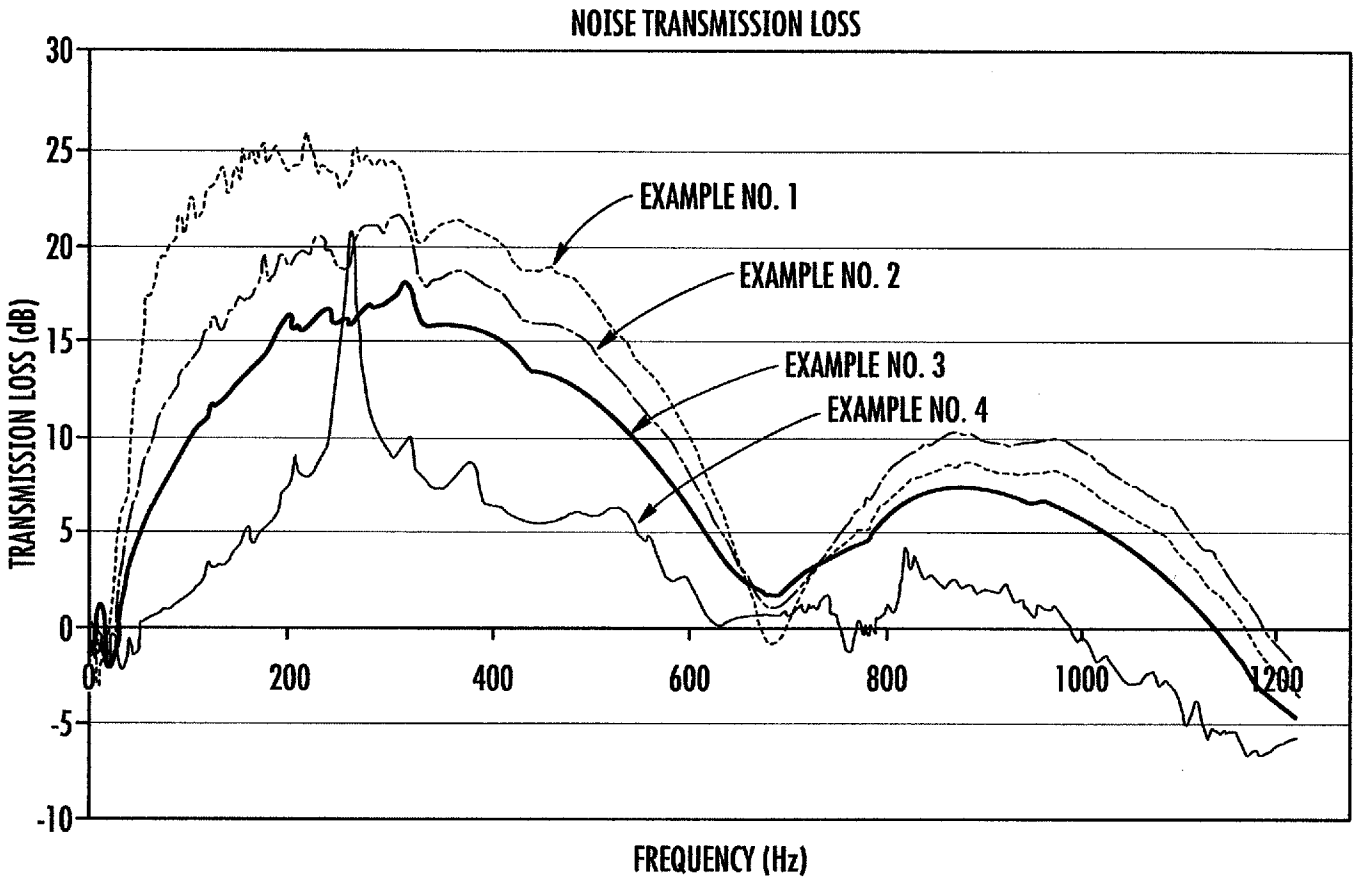
FIG. 8 is a graphical representation of test data illustrating the noise transmission loss as a function of frequency for each of the four examples of woven acoustic material.

To measure the loss of noise transmission, a test conduit with a portion of the side wall removed was covered with an acoustic membrane and one end of the conduit was mounted on a speaker box. A four pole transmission loss test was conducted with a pair of microphones mounted on the conduit upstream of the acoustic membrane and the other pair located downstream of the membrane. White noise was introduced into the conduit at the speaker and the noise reduction downstream of the membrane was recorded as a function of frequency. The graph in FIG. 8 represents the noise transmission loss for each of the four examples whose physical properties as shown in the chart of FIG. 6.

Figure 9:
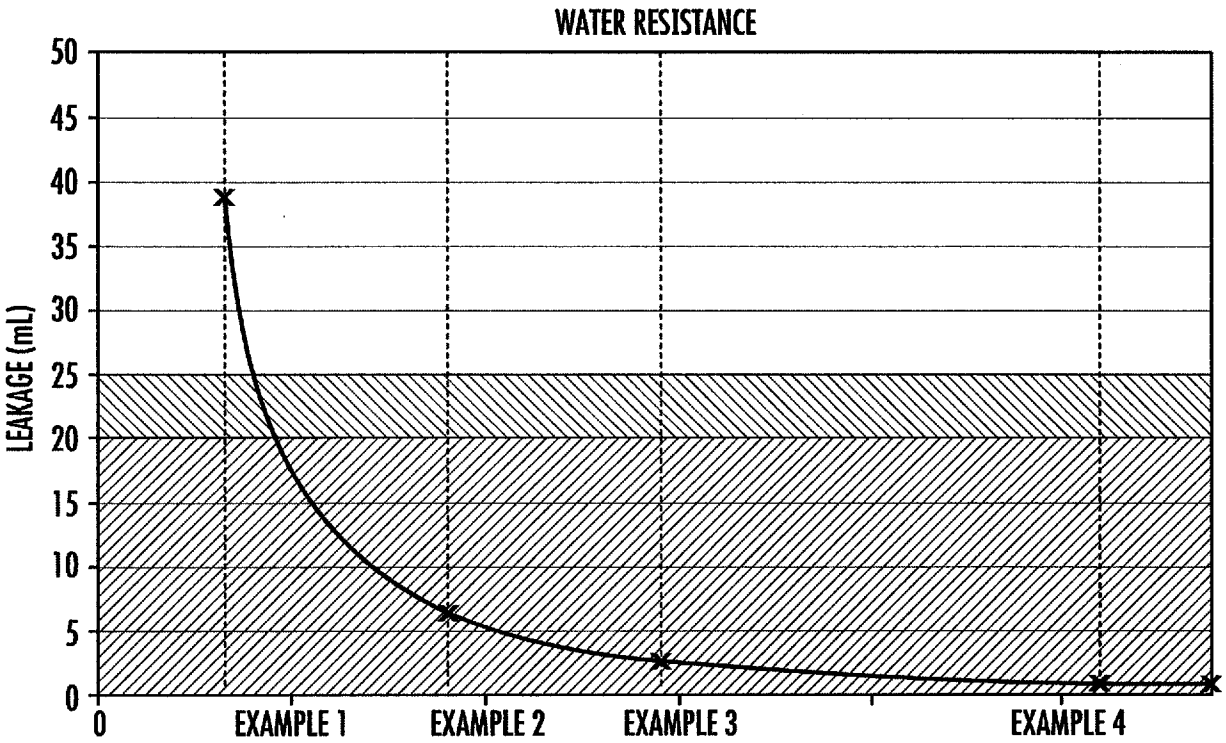
FIG. 9 is a graphical representation of the water resistance for each of the four examples of woven acoustic material.

To measure the resistance to water intrusion, a U shaped test conduit was constructed. A portion of the upper wall of the horizontal leg of the U shaped test conduit was removed and covered with a water resistant acoustic material. The U shaped conduit was then submerged in a water tank such that the sample was exposed to a 100 mm column of water for thirty seconds; the upper end of each vertical leg of the U shaped conduits being located above the water line. The quantity of water that passed through the membrane was recorded for each of the four examples whose physical properties as shown in the chart of FIG. 6 and the results shown graphically in FIG. 9.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The invention claimed is:

1. An air induction passageway for an internal combustion engine comprising;

an air intake duct, said air intake duct having an inlet end and an outlet end and a passageway defined by a side wall extending between said inlet end and outlet end, said air intake duct including an opening formed in a portion of said wall, a flange formed on the outer surface of said air intake duct surrounds said opening, said flange being directed radially outward from the wall of said air intake duct and a grid having an outer perimeter frame that conforms to an inner perimeter formed by said flange;

said air induction passageway further including an acoustic membrane mounted within said opening, said acoustic membrane is sized to fit within said flange and fit within said opening;

said acoustic membrane being formed from a woven material wherein the woven material of said acoustic membrane has a weight within the range of 25 to 85 g/m$^2$ a pore size that falls within the range of 38um to 18um and a thickness that falls within the range of 40um to 125um, said woven material being positioned between said grid and said outer surface of said air intake duct, whereby said acoustic membrane reduces inlet noise by dissipating pressure waves in the air intake duct.

2. An air induction passageway for an internal combustion engine comprising;

an air intake duct, said air intake duct having an inlet end and an outlet end and a passageway defined by a side wall extending between said inlet end and outlet end, said air intake duct including an opening formed in a portion of said wall, a flange formed on the outer surface of said air intake duct surrounds said opening, said flange being directed radially outward from the wall of said air intake duct and a grid having an outer perimeter frame that conforms to an inner perimeter formed by said flange;

said air induction passageway further including an acoustic membrane mounted within said opening, said acoustic membrane is sized to fit within said flange and fit within said opening;

said acoustic membrane being formed from a woven material having a weight within the range of 25 to 85 g/m$^2$ that allows sufficient air flow into said air intake duct as well as resisting water penetration into the air intake duct, said woven material being positioned between said grid and said outer surface of said air intake duct, whereby said acoustic membrane reduces inlet noise by dissipating pressure waves in the air intake duct.

3. The air induction passageway for an internal combustion engine as set forth in claim 2 wherein the woven material of said acoustic membrane has a pore size that falls within the range of 38um to 18um.

4. The air induction passageway for an internal combustion engine as set forth in claim 2 wherein the woven material of said acoustic membrane has a thickness that falls within the range of 40um to 125um.

5. The air induction passageway for an internal combustion engine as set forth in claim 4 wherein the woven material of said acoustic membrane has a pore size that falls within the range of 38um to 18um.

6. The air induction passageway for an internal combustion engine as set forth in claim 5 wherein the woven material of said acoustic membrane is finished with a coating that enables the membrane to repel water.

7. The air induction passageway for an internal combustion engine as set forth in claim 2 further including an inlet component having an air inlet side, an air outlet side and a longitudinal passageway there between, said air inlet side including indexing and attachment elements to secure said inlet component to the vehicle structure.

8. The air induction passageway for an internal combustion engine as set forth in claim 7 wherein said air outlet side of said inlet component includes a circumferential groove that is sized and configured to receive a radially directed flange that is located on the inlet end of said air intake duct.

9. The air induction passageway for an internal combustion engine as set forth in claim 2 wherein said outer perimeter frame is rectangular and the inner perimeter formed by said flange is rectangular.

10. The air induction passageway for an internal combustion engine as set forth in claim 2 wherein said grid includes a plurality of angled louvers.

11. The air induction passageway for an internal combustion engine as set forth in claim 2 wherein said opening is located on a bottom portion of said side wall.

12. The air induction passageway for an internal combustion engine as set forth in claim 2 wherein the woven material of said acoustic membrane is woven with mono filament fibers thereby producing uniform mesh openings and creating a consistent acoustical resistance.

13. The air induction passageway for an internal combustion engine as set forth in claim 2 wherein the air intake duct adjacent the outlet end has fastening and indexing elements formed on the outer surface of said air intake duct.

* * * * *